US005746480A

United States Patent [19]

Bonutti

[11] Patent Number: 5,746,480

[45] Date of Patent: May 5, 1998

[54] ARMREST ASSEMBLY

[76] Inventor: Peter M. Bonutti, 1303 W. Evergreen Plaza, Effingham, Ill. 62401

[21] Appl. No.: 289,300

[22] Filed: Aug. 11, 1994

Related U.S. Application Data

[60] Division of Ser. No. 955,201, Oct. 1, 1992, Pat. No. 5,407,249, which is a continuation-in-part of Ser. No. 597,691, Oct. 15, 1990, Pat. No. 5,215,282.

[51] Int. Cl.[6] ..... A47C 7/54

[52] U.S. Cl. ..... 297/411.35; 248/118

[58] Field of Search ..... 297/411.34, 411.35, 297/411.36, 411.37, 411.45; 248/118, 118.1, 118.3, 118.5, 918

[56] References Cited

U.S. PATENT DOCUMENTS

| | | |
|---|---|---|
| 406,196 | 7/1889 | Clayton et al. . |
| 1,279,120 | 9/1918 | Kellogg . |
| 1,721,221 | 7/1929 | Jauregui . |

(List continued on next page.)

FOREIGN PATENT DOCUMENTS

| | | | |
|---|---|---|---|
| 818911 | 7/1969 | Canada . | |
| 240222 | 10/1965 | Germany . | |
| 42022 | 10/1965 | Germany . | |
| 2836646 | 3/1980 | Germany | 297/411.37 |
| 62687 | 8/1944 | Netherlands . | |
| 2119067 | 11/1983 | United Kingdom . | |
| WO89/00111 | 1/1989 | WIPO . | |

OTHER PUBLICATIONS

"Moving Armrest" and Ego Chair Product Information Occupational Health & Safety, Sep. 1991, p. 56.

Power Trax Literature, two pages (pp. 4,5) entitled "Power Trax Ball Splines", undated.

Unidentified Literatute, one page (p. 100) on spline shafts, undated.

Thomson Systems Literature, one page (p. 31) entitled "Double Shaft Unsupported System", undated.

LM76 Inc. Literature, one page, (unpaginated), entitled "Ceramic Linear Motion Bearings", undated.

Pacific Bearing Co. Literature, one page (unpaginated), entitled "Linear Bearing Selection Guide", undated.

Mabs Arm Brochure, three pages (unpaginated), undated.

THK Literature, one page (p. 7) entitled Guide Type SR . . . T/S, undated.

THK Literature, one page (p. 48) entitled "THK type DP", undated.

(List continued on next page.)

*Primary Examiner*—Flemming Saether

*Attorney, Agent, or Firm*—Tarolli, Sundheim, Covell, Tummino & Szabo

[57] ABSTRACT

An armrest assembly for attachment to a chair includes a base plate. The base plate can be secured, in a chair of the type including a (i) seat bottom cushion on which a person can sit, (ii) a pedestal assembly supporting the seat bottom cushion, and (iii) a plurality of fasteners securing the pedestal assembly to the underside of the seat bottom cushion, between the seat bottom cushion and the pedestal. The base plate has a plurality of fastener openings equal in number to the number of fasteners in the chair to which the armrest assembly is to be attached. The fastener openings are arranged in the same pattern as the fasteners in the chair to which the armrest assembly is to be attached. The base plate can have at least two sets of fastener openings arranged in different patterns, whereby the base plate can selectively be secured intermediate the pedestal assembly and the seat bottom cushion of at least two different chairs having different fastener patterns. The armrest slides relative to the armrest support, allowing the armrest to be moved laterally, rather than only arcuately, compensating for the arcuate motion provided by a pivot joint. The armrest assembly is responsive to downward force on the armrest from the person's arm to restrict movement of the armrest relative to said base. Pressure (i.e., weight of the arm or gravity) locks the armrest into a given position, providing a more stable working platform.

32 Claims, 11 Drawing Sheets

U.S. PATENT DOCUMENTS

| | | | |
|---|---|---|---|
| 1,782,660 | 11/1930 | Meyer . | |
| 1,816,747 | 7/1931 | Rogers, Sr. . | |
| 2,602,488 | 7/1952 | Conning . | |
| 2,690,794 | 10/1954 | Ahern | 297/411.37 |
| 2,950,890 | 8/1960 | Hough | 248/118 |
| 3,140,119 | 7/1964 | Offner | 297/411.35 |
| 3,241,884 | 3/1966 | Thatcher et al. . | |
| 3,614,085 | 10/1971 | Cunningham . | |
| 3,929,309 | 12/1975 | De Vore | 248/118 |
| 3,950,026 | 4/1976 | Van Seenus | 297/411.37 |
| 4,155,588 | 5/1979 | Danziger | 297/411.34 |
| 4,159,148 | 6/1979 | Schulz . | |
| 4,277,102 | 7/1981 | Aaras et al. . | |
| 4,332,263 | 6/1982 | Kitrell . | |
| 4,481,556 | 11/1984 | Berke et al. . | |
| 4,576,351 | 3/1986 | Brink | 248/118 |
| 4,621,781 | 11/1986 | Springer . | |
| 4,688,862 | 8/1987 | Fowler et al. . | |
| 4,789,249 | 12/1988 | Mutolo . | |
| 4,815,862 | 3/1989 | Mugglestone et al. . | |
| 4,822,103 | 4/1989 | Stenvall . | |
| 4,913,393 | 4/1990 | Wood . | |
| 4,960,304 | 10/1990 | Frantz . | |
| 4,997,054 | 3/1991 | Denny et al. . | |
| 5,029,941 | 7/1991 | Twisselmann . | |
| 5,058,840 | 10/1991 | Moss et al. . | |
| 5,108,057 | 4/1992 | Dandy, III et al. . | |
| 5,143,422 | 9/1992 | Althofer et al. . | |
| 5,281,001 | 1/1994 | Bergsten et al. . | |

OTHER PUBLICATIONS

THK Literature, one page (p. 122) entitled "THK Ball Spline Type LMT", undated.

THK Literature, one page (unpaginated), on Epochal Linear Motion Systems, undated.

Linear Industries Ltd. Catalog, pp. 1–72, Section A, pp. 1–5, 32–37 of Section C, pp. 1–8 of Section D, copyright date of 1977.

Ergo Arm Sit–Rite Brochure, four pages (unpaginated), undated.

Rini Ergoteknik Ab Brochure, two pages (unpaginated), 851215.

Rini Ergoteknik Ab Brochure, two pages (unpaginated), dated 1990.

ARMREST ASSEMBLY

This application is a divisional of application Ser. No. 07/955,201, filed Oct. 1, 1992 (Now U.S. Pat. No. 5,407,249) which is a continuation-in-part of application Ser. No. 07/597,691, filed on Oct. 15, 1990 (Now U.S. Pat. No. 5,215,282). The benefit of the earlier filing dates of the aforementioned applications Ser. Nos. 07/955,201, filed Oct. 1, 1992 and 07/597,691, filed Oct. 16, 1990, under Title 35, United States Code, Section 120 is claimed.

BACKGROUND OF THE INVENTION

1. Technical Field

The present invention relates to an armrest assembly for attachment to a chair.

2. Description of the Prior Art

Existing furniture for typists, computer users, and others using their hands to work does not properly position the hands relative to the work, and does not properly support the arm in any given position. One function of the elbow is to position the hand in space. Thus, proper positioning of the elbow itself is essential to proper positioning of the hand. The elbow is typically supported by the armrest on a chair. However, the armrests on a typical office chair are completely useless to support the arms of someone working at a computer keyboard, for example. The armrests are too far back and too low because the chair must be designed to fit under a table or desk, and because the occupant must be able to get into and out of the chair easily without serious interference from the armrests. The armrests do not properly support the weight of the arms. Thus, the trapezius muscle and other muscles of the neck and shoulder must support the full weight of the arms for prolonged periods of time, leading to chronic shoulder and neck pain, upper back problems, etc.

It would be desirable to provide a chair, or an armrest assembly for attachment to a chair, which (i) properly supports the weight of the arm of a person sitting in the chair, (ii) at the correct location, which may be adjustable, and (iii) allows for full movement of the person's hand through the desired range of motion without losing the support of the armrest. Such an armrest assembly should preferably be easily attachable to many different chairs without substantial modification.

SUMMARY OF THE INVENTION

The present invention relates to an armrest assembly for attachment to a chair or other type of work station such as a bench, desk, or table.

In accordance with one feature of the invention, the armrest assembly includes a base plate adapted to be secured intermediate the pedestal assembly and the seat bottom cushion of a typical office chair, with the fasteners which secure the pedestal assembly to the seat bottom cushion extending through fastener openings in the base plate. Thus, the armrest assembly is easily attachable to the chair without structural change to the chair. The base plate preferably has at least two sets of fastener openings arranged in different patterns, whereby the base plate can selectively be secured intermediate the pedestal assembly and the seat bottom cushion of at least two different chairs having different fastener patterns. Thus, one armrest assembly is easily attachable to a number of different chairs without structural change to any of the chairs.

In accordance with another feature of the invention, the armrest itself slides relative to the armrest support. This provides for an additional degree of movement for the arm. Specifically, it allows the hand to move laterally (for example, along a keyboard) without lifting off from the armrest or sliding along the armrest. If the arm only pivots, by virtue of the pivotal movement provided by two pivot joints in the armrest, the hand travels in a circular arc with the armrest as the center of rotation. In this case, the hand, for example, can not follow the home row of keys on the keyboard as it moves left to right. However, with the sliding motion provided by the present invention, the hand can move forward and backward as well as pivot. This compensates for the arcuate motion provided by a pivot joint, and allows the hand to travel as desired by the operator.

In accordance with another feature of the invention, the armrest assembly includes joint means responsive to downward force on the armrest from the person's arm to restrict movement of the armrest relative to the base. Pressure (i.e., weight of the arm or gravity) partially or completely locks the armrest into a given position, providing a more stable working platform. The joint means may be constructed by selection of materials to provide free movement when desired and restriction of movement when desired.

The armrest slide is preferably self-centering in its sliding motion. The armrest is preferably pivotal about the armrest support member through a range of motion of 360°, with detent stops generally limiting the pivoting motion to a range of about 90°.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT

Figure 1:
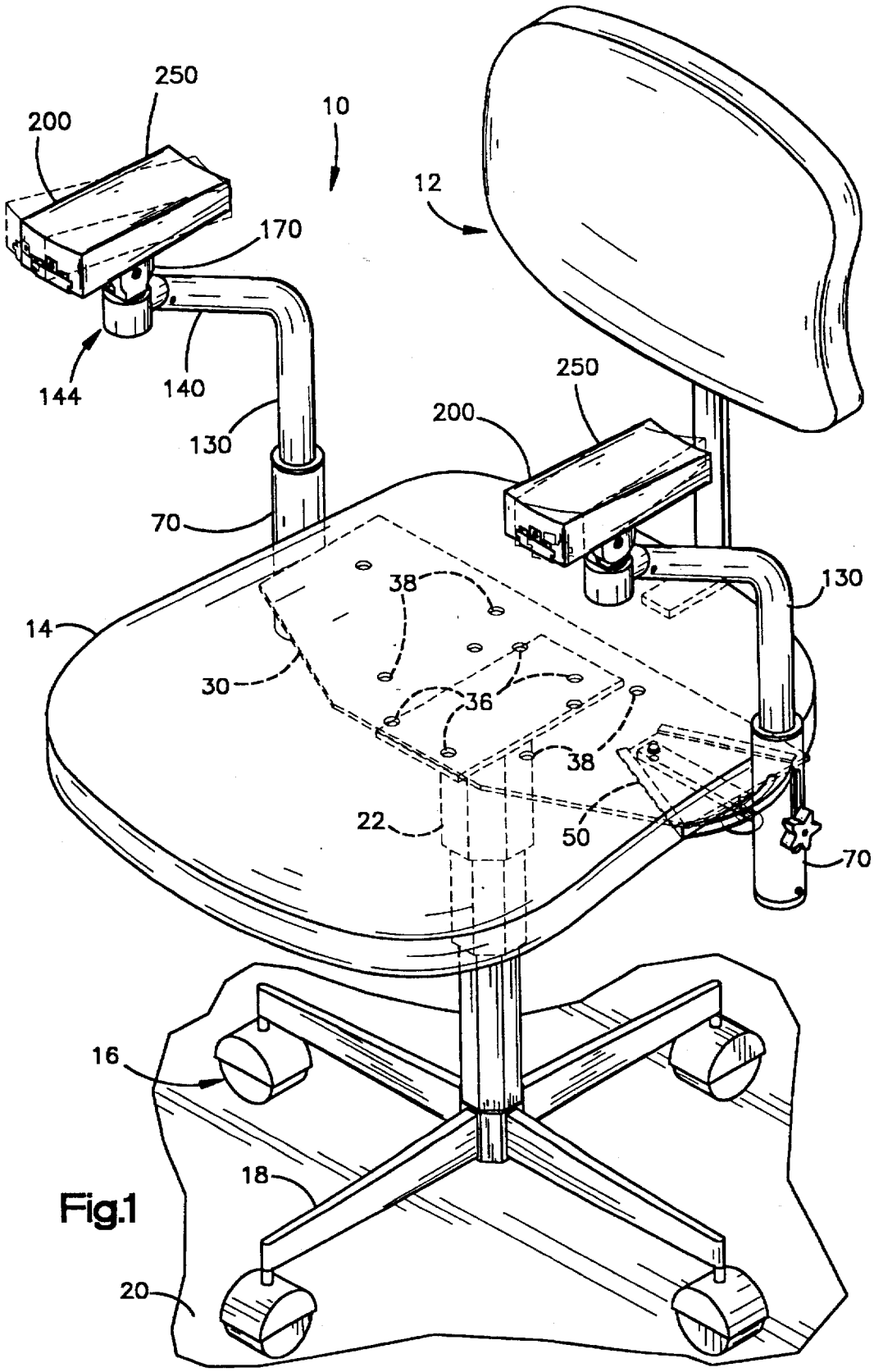
FIG. 1 is a front left perspective view of a chair having attached to it an armrest assembly in accordance with the present invention, with the armrest itself not shown.
Figure 2:
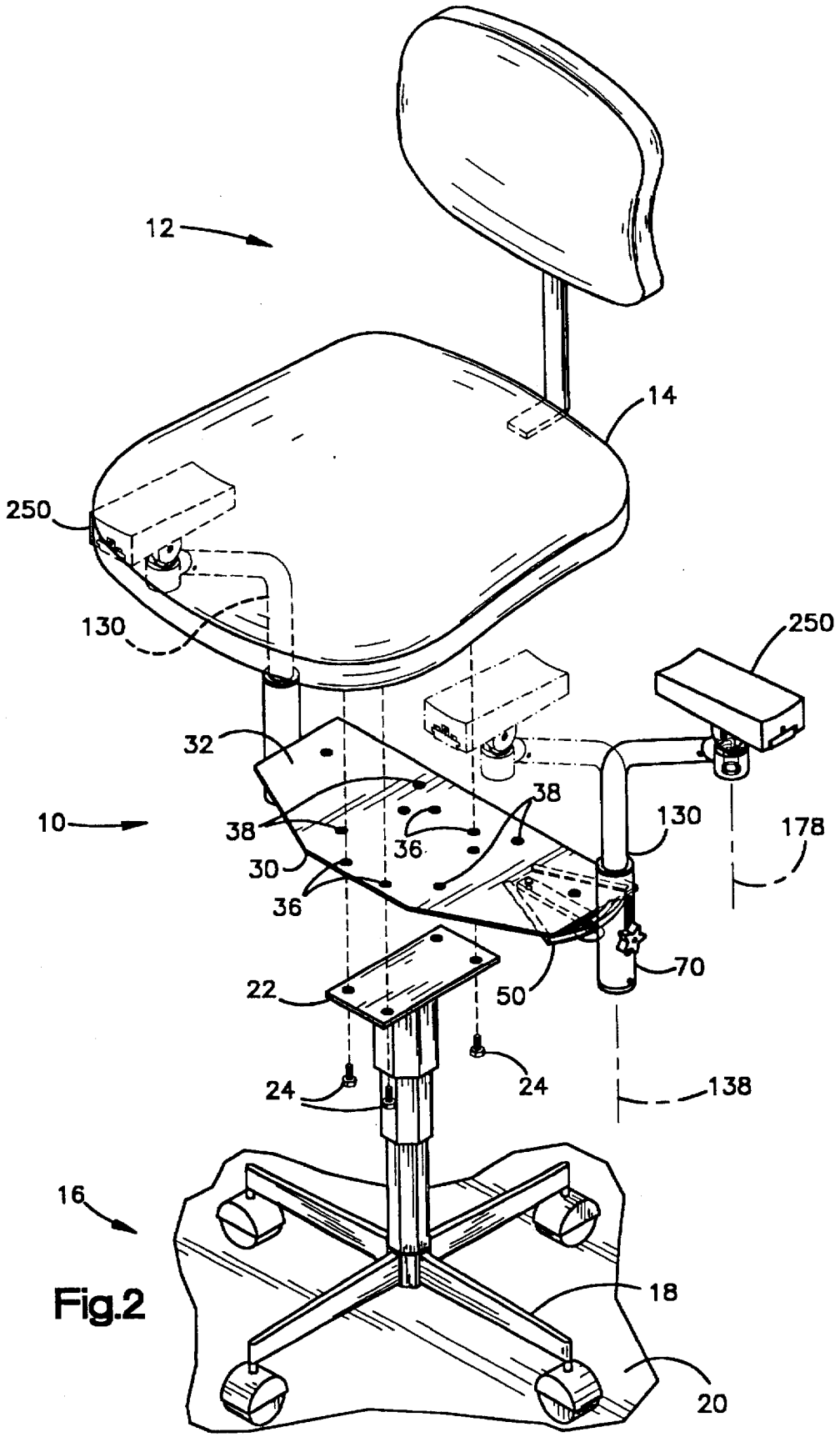
FIG. 2 is a partially exploded view of the chair and armrest assembly of FIG. 1.
Figure 3:
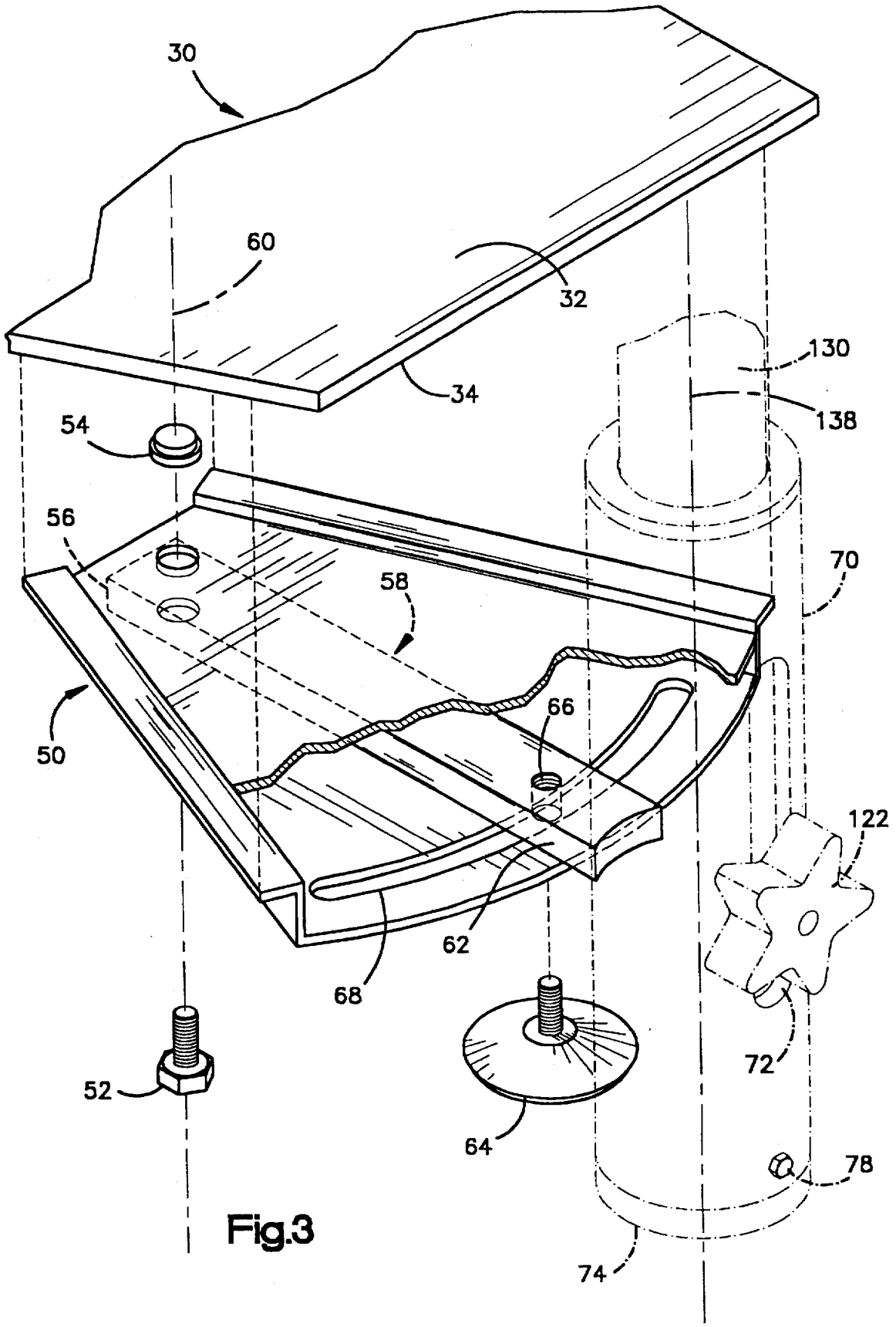
FIG. 3 is an enlarged view of a lower portion of the armrest assembly of FIG. 1.
Figure 4:
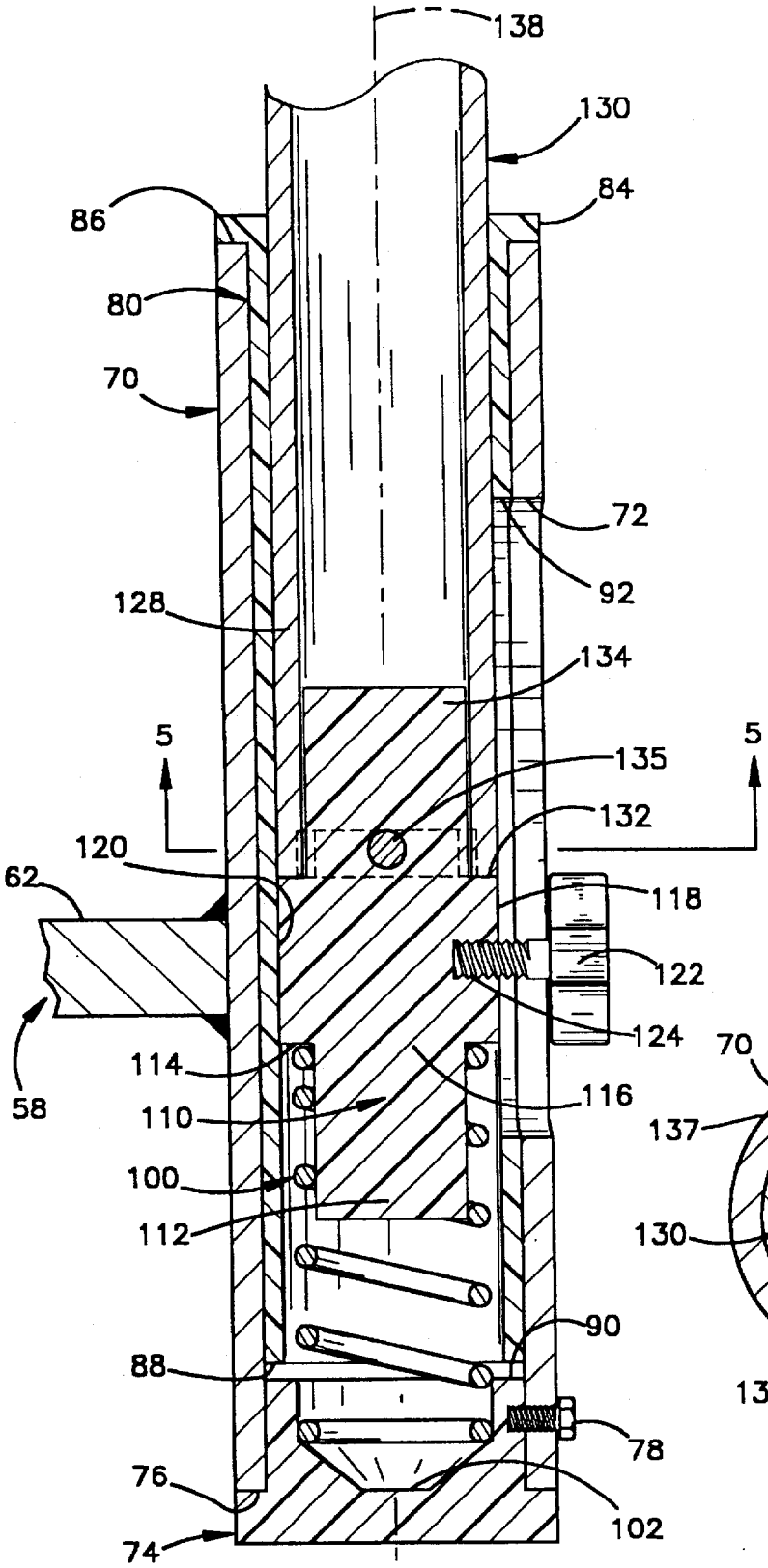
FIG. 4 is a sectional view of a lower portion of the armrest assembly of FIG. 1.
Figure 5:
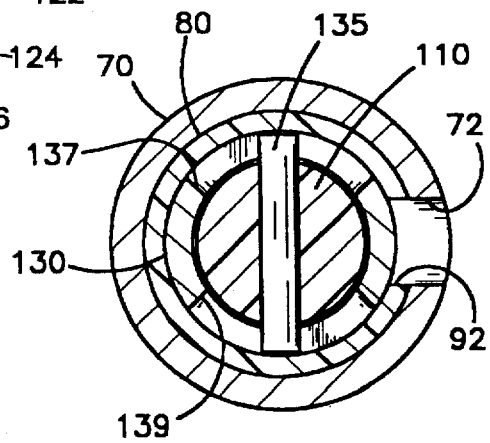
FIG. 5 is a sectional view taken along line 5—5 of FIG. 4.
Figure 6:
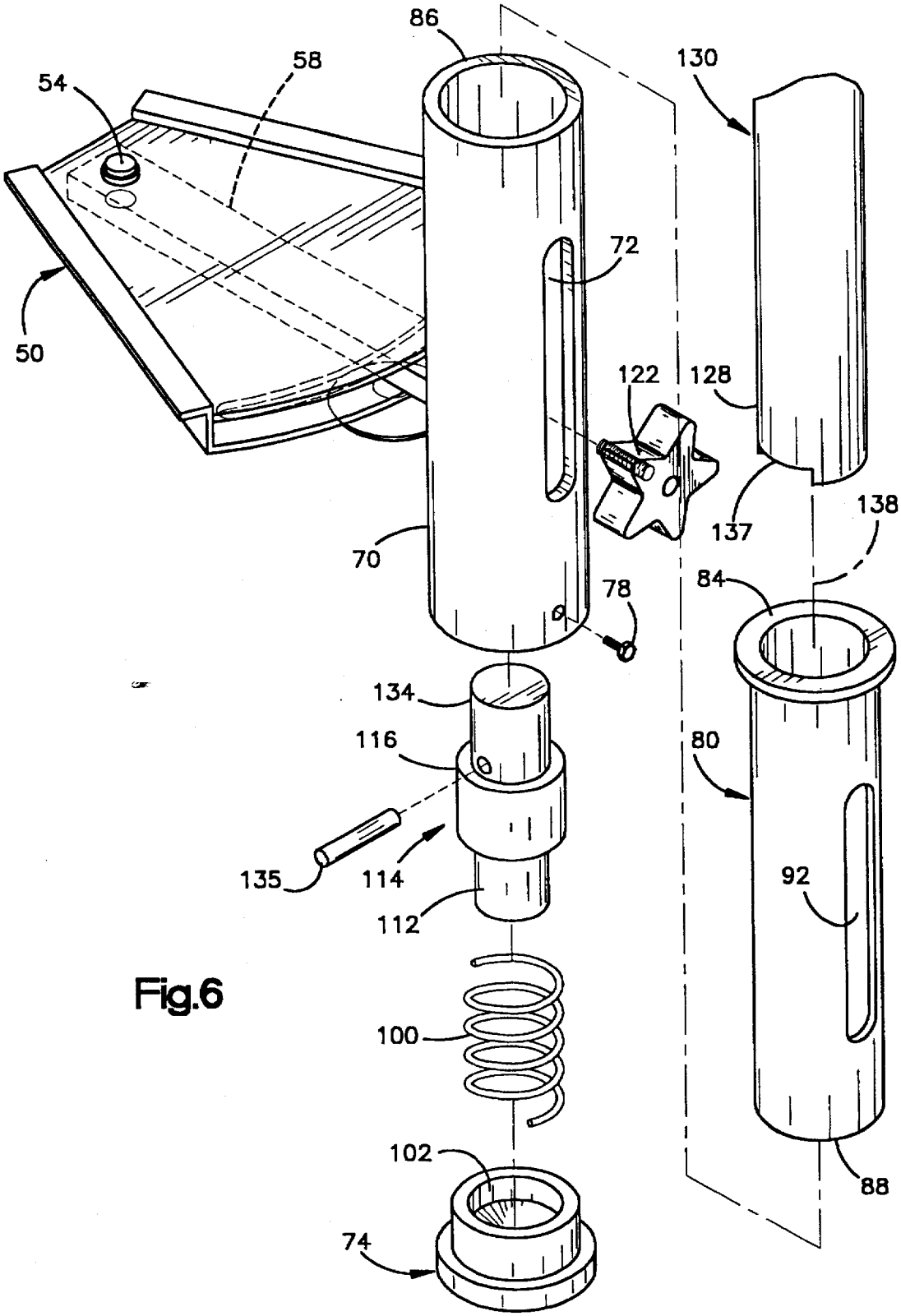
FIG. 6 is an enlarged exploded view of a lower portion of the armrest assembly of FIG. 1.

The present invention relates to an armrest assembly for attachment to a work station such as a chair or the like. The present invention is applicable to various armrest assembly constructions. The present invention is illustrated in FIG. 1 as applied to an armrest assembly 10 for use with a known chair 12.

The chair 12 is of the type including a seat bottom cushion 14 on which a person can sit. A pedestal assembly 16 has a lower portion 18 engageable with a floor 20 and an upper portion 22 connected with the seat bottom cushion 14. A plurality of fasteners 24 extend between the pedestal assembly upper portion 22 and the seat bottom cushion 14. The fasteners 24 secure the pedestal assembly upper portion 22 to the underside of the seat bottom cushion 14 to support the seat bottom cushion off the floor 18. The fasteners 24 are spaced apart from each other and arranged in a particular pattern unique to that chair. Other chairs of the same type, from different manufacturers or different models from the same manufacturer, will have different fastener patterns.

The armrest assembly 10 includes a base plate 30. The base plate 30 is a planar piece of steel which is sized to fit the underside of a chair seat bottom cushion, typically, about 10×16 inches. The base plate 30 has an upper major side surface 32 and a lower major side surface 34. The base plate can be curved to fit a curved seat bottom cushion, if necessary.

The base plate 30 has a first set of fastener openings 36 disposed in a pattern on the base plate. The fastener openings 36 are disposed in the same pattern as are the fasteners 24 of the chair 12. The fastener openings 36 extend between the upper major side surface 32 and the lower major side surface 34 of the base plate 30.

The base plate 30 also has a second set of fastener openings 38 which extend between the upper major side surface 32 and the lower major side surface 34 of the base plate 30. The fastener openings 38 are disposed on the base plate in a different pattern than the fastener openings 36.

The base plate 30 is secured between the seat bottom cushion 14 and the pedestal 16 of the chair 12. The fasteners 24 secure the pedestal 16 and the base plate 30 to the chair 12. The fasteners 24 extend through the first set of fastener openings 36. Thus, the armrest assembly 10 is secured to the chair 12 without destruction or significant alteration of the chair.

The armrest assembly 10 can alternatively be secured to a second chair (not shown) different from the chair 12, having a pedestal with fasteners disposed in a different pattern. For example, if the second chair has fasteners disposed in a pattern like the pattern of the second set of fastener openings 38 in the base plate 30, then the base plate can be easily secured to the second chair simply between the seat bottom cushion and the pedestal of the second chair. The fasteners would extend through the second set of fastener openings 38.

Thus, it can be seen that an armrest assembly in accordance with the present invention can be selectively attached to different chairs, simply by providing appropriate sets of fastener openings in the base plate. A base plate designed with certain sets of fastener openings will fit chairs from most of the major office chair manufacturers available.

The base plate 30 has two steel brackets 50 welded to it, one on each side. Each bracket 50 is pie-shaped in plan view and U-shaped in cross-section. Each bracket has near its inner end a pivot pin 52 and push nut assembly 54. Each pivot pin 52 and push nut assembly 54 secures the inner end 56 of a respective steel swing arm 58 for pivotal movement relative to its bracket 50 about a generally vertical axis 60. This allows pivotal movement of the swing arm 58 within a range of about 45° or so. The brackets 50 are located so as to be between pedestal mounting areas. Thus, the outer ends 62 of the swing arms 58 are accessible on the sides of the chair. (From this point on, the description of the preferred embodiment will describe only one side of the armrest assembly 10, the other side being a mirror image.)

At an outer location on the swing arm 58, a lock screw 64 extends through a threaded opening 66 in the swing arm and through an arcuate slot 68 in the bracket 50. The lock screw 64 locks the swing arm 58 in a selected pivotal position relative to the bracket 50.

A steel upright 70 is welded to the outer end 62 of the swing arm 58. The upright 70 is a tubular member open ended at top and bottom. A vertically extending slot 72 is formed on the laterally outermost portion of the upright 70.

A plastic end cap 74 is inserted upwardly up into the open bottom end 76 of the upright. A set screw 78 extends radially through the wall of the upright 70 and secures the end cap 74 in place. The end cap 74 closes the bottom end 76 of the upright 70.

A tubular plastic bearing 80 is inserted downwardly into the top end of the upright 70. The bearing 80 is open ended top and bottom. A shoulder 84 on the upper end of the bearing 80 engages the upper end face 86 of the upright 70 and limits downward movement of the bearing into the upright. There is about a ⅛" gap between the bottom 88 of the bearing 80 and the top 90 of the end cap 74. The bearing 80 has a vertically extending slot 92 which is alignable with the slot 72 on the upright 70.

A compression spring 100 is inserted downwards into the upright 70, through the bore of the bearing 80. The lower end of the spring 100 is received in a conical upwardly facing chamber 102 in the end cap 74.

A solid plastic spring guide 110 is then dropped down into the upright 70, through the bore of the bearing 80. The lower end 112 of the spring guide 110 is received in the upper end of the spring 100. An annular radially extending surface 114 on a shoulder portion 116 of the spring guide 110 engages the upper end of the spring 100. An outer cylindrical surface 118 of the shoulder portion 116 engages an inner cylindrical surface 120 of the bearing 80 to center the spring guide 110 radially in the upright.

A lock screw 122 extends radially through the slot 72 in the upright 70 and through the slot 92 in the bearing 80. The lock screw 122 is threaded into an opening 124 in the shoulder portion 116 of the spring guide 110. Tightening the lock screw 122 pulls the spring guide 110 radially outwardly tightly against the upright 70, blocking vertical movement of the spring guide 110. The lock screw 122 supports the weight of the spring guide 110.

A lower end portion 128 of a hollow tubular steel support tube 130 extends down inside the bearing 80 and rests on an annular radially extending surface 132 on the shoulder portion 116 of the spring guide 110. An upper end portion 134 of the spring guide 110 is received inside the lower end portion 128 of the support tube 130.

The spring guide 110 carries the weight of the support tube 130. The support tube 130 is thus supported for pivotal movement in the upright 70, about a generally vertical axis 138. The vertical position of the support tube 130 is adjustable by loosening the lock screw 122, moving the support tube up or down to the desired position, then tightening the lock screw. The spring 100 assists in adjusting by partially carrying the weight of the parts above it during adjustment.

A roll pin 135 extends diametrically through the spring guide 110. The ends of the roll pin 135 are received in diametrically opposed pockets 137 and 139 formed in the lower end portion 128 of the support tube 130. The rotation of the support tube 130 about the axis 138 is limited by engagement of the roll pin 135 with the radially extending walls defining the ends of the pockets 137 and 139. Preferably, about 90° to about 120° of rotation is provided.

The support tube 130 extends upward from the upright 70 and then curves forward at about 26° above horizontal. The upper end portion 140 of the support tube 130 receives a first portion 142 of a plastic socket member 144. A self-tapping set screw 146 extends through a through hole 148 in the support tube upper end portion 140 and into the socket member first portion 142 to secure the socket member 144 in the support tube 130. A second self-tapping set screw 150 extends through the opposite side of the support tube upper end portion 140 and into the socket member first portion 142.

The socket member 144 has a second portion 154 extending at a 26° angle from the first portion 142 so that it is horizontal. A socket 156 extends vertically top to bottom through the socket member second portion 154. The lower end of the socket 156 is widened at 158. A pair of 90° pockets 160 are formed at the upper end of the socket 156.

A plastic armrest support post 170 has a lower portion 172 rotatably received in the socket 156. The bottom of the lower portion 172 is split to form barbs 174. When the support post 170 is inserted into the socket 156 the barbs 174 are pushed radially inward then spring out into the widened lower end portion 158 of the socket to hold the post in the socket. The post 170 has stops 176 which are received in the pockets 160 in the socket member 144 to limit rotation of the support post about a vertical axis 178. The stops 176 limit the pivoting motion of the armrest support post 170, relative to the support tube 130, to a range of about 90°.

The support post 170 has a through opening 180 for a carriage bolt 182. The carriage bolt 182 secures the support post 170 to a plastic lower slide member 190. Thus, the lower slide member 190 is rotatable about the vertical axis 178, with the post 170, relative to the support tube 130.

The lower slide member 190 has two laterally projecting tenons 192 which extend the length (about 6.5") of the lower slide member. The tenons 192 fit in a mortise 194 in a plastic upper slide member 200. The upper slide member 200 is thus slidably mounted on the lower slide member 190 for movement in a direction parallel to an axis 202.

A stop pin 204 is threaded into the center of the lower slide member 190. The stop pin 204 projects upward from the lower slide member 190 into the open center of the upper slide member 200. Two spring assemblies 206 are received between the stop pin 204 and outer ends 208 of the upper slide member. Each spring assembly 206 includes a plastic inner spring guide 210, a very light compression spring 212, and a plastic outer spring guide 214. Each outer spring guide 214 has a nib 216 which snaps into a small opening 216 in a respective outer end 208 of the upper slide member 200.

The spring assemblies 206 provide a spring-biased self-centering effect for the upper slide member 200 in its sliding movement relative to the lower slide member 190. When the upper slide member 200 is at one limit of its sliding movement relative to the lower slide member 190, one spring 212 is compressed and the inner and outer spring guides 210 and 214 on that side engage to limit sliding movement in that direction. At that time, the other spring 212 is fully extended. The upper slide member 200 has walls 218 which keep the springs 212 from moving laterally out of position.

Two bearing assemblies 230 support the upper slide member 200 for sliding movement on the lower slide member 190. The bearing assemblies 230 are disposed laterally on either side of the spring assemblies 206. Each bearing assembly 230 includes a plurality of 3/16" steel ball bearings 232 received in a plastic ball keeper 234. The ball keeper 234 has one support hole 236 for each ball bearing. Each support hole 236 is big enough for a ball bearing 232 to drop in from the top. The bottom of each support hole 236 is tapered inward to support the ball bearing 232 and keep it from falling out through the bottom of the support hole. Preferably about 0.015" of the ball bearing 232 protrudes from the top of the ball keeper 234, and about 0.015" of the bearing protrudes from the bottom of the ball keeper. Both ends of the ball keeper 234 are bent as at 240 to provide spring tension and avoid rattling.

Figure 7:
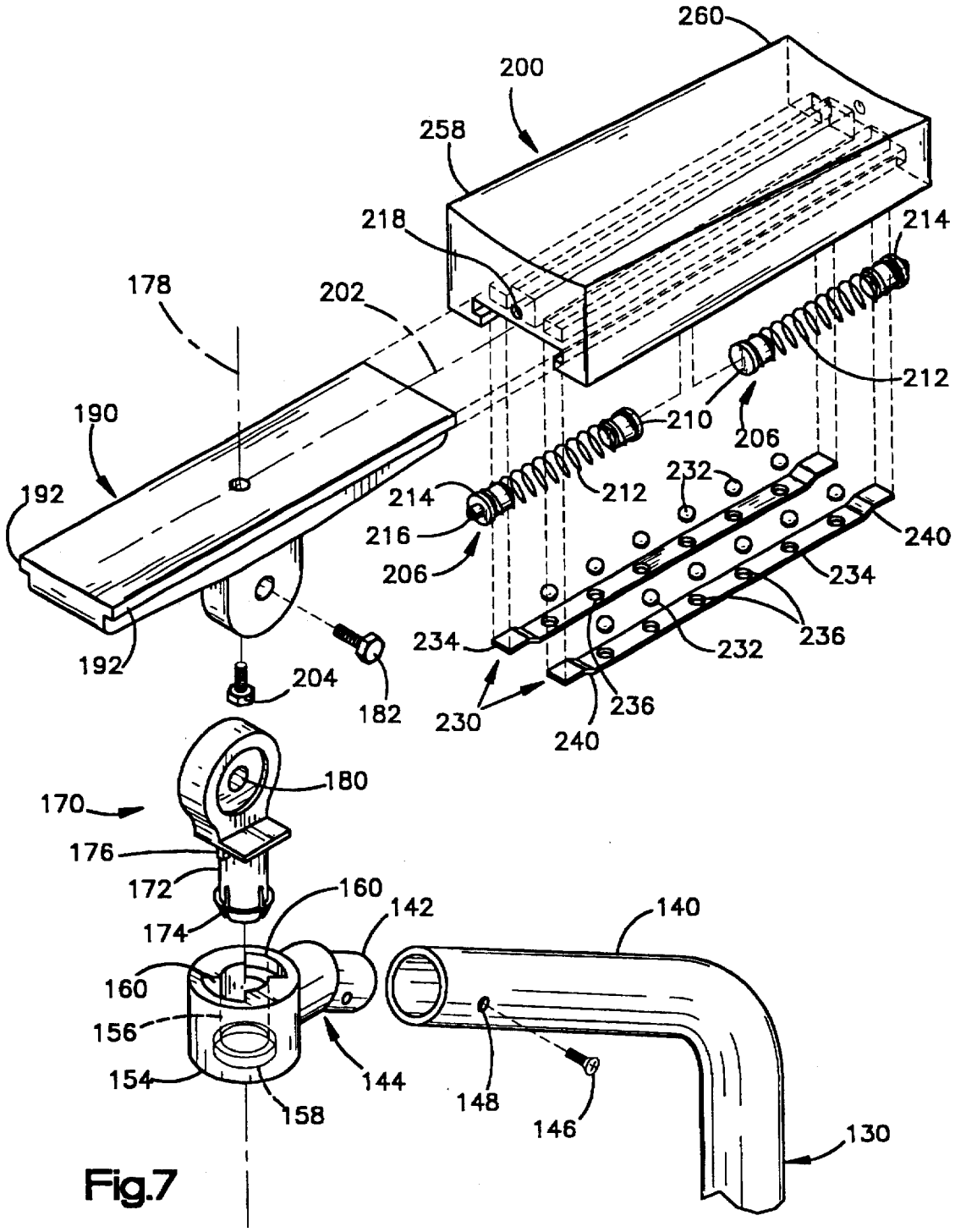
FIG. 7 is an enlarged exploded view of an upper portion of the armrest assembly of FIG. 1, with the armrest itself not shown.
Figure 8:
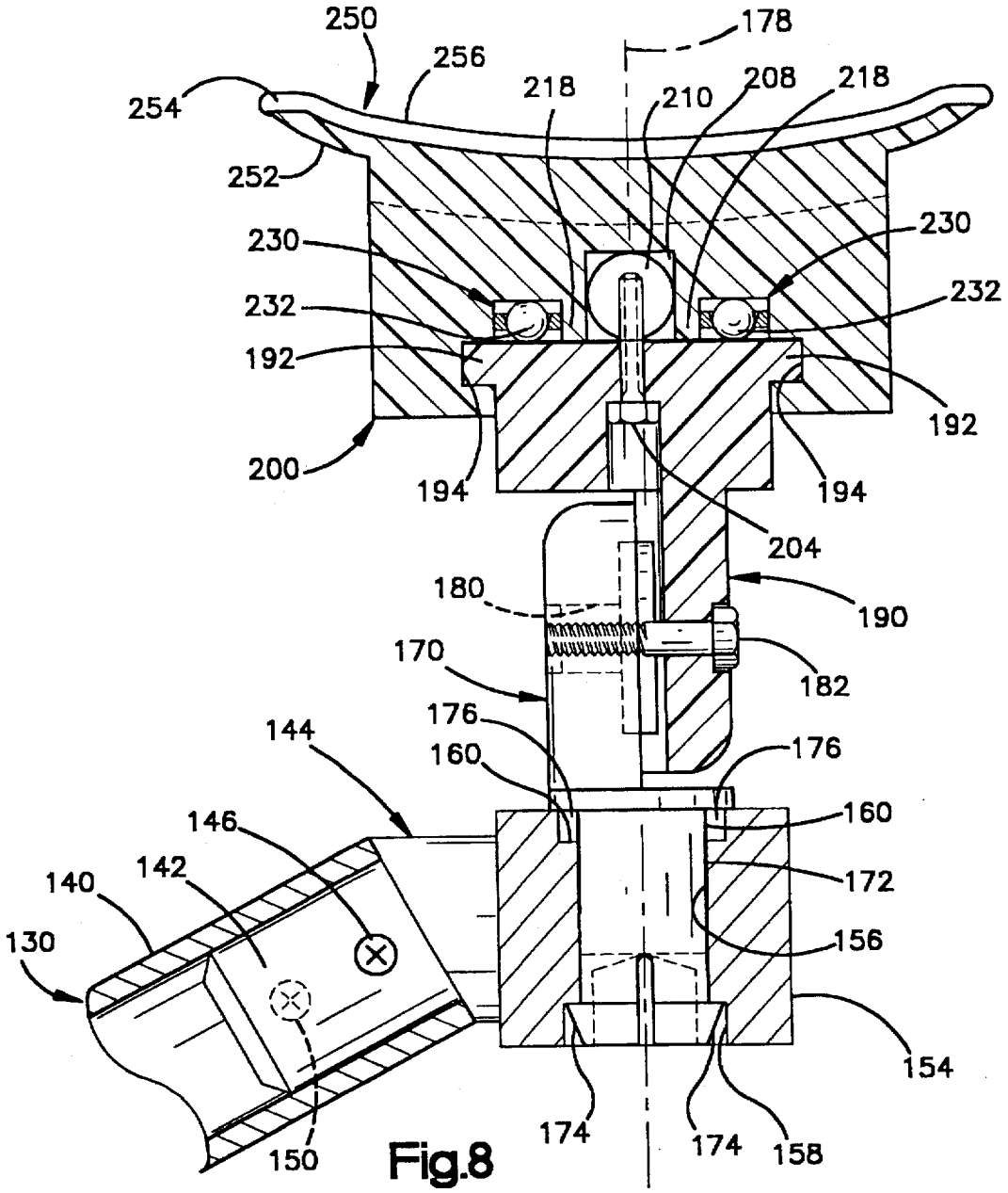
FIG. 8 is a sectional view of the an upper portion of the armrest assembly of FIG. 1, showing the armrest itself.

An armrest 250 (FIG. 8; not shown in other FIGS.) is fixed for movement with the upper slide member 200. The armrest 250 includes a hard plastic shell 252 which is preferably molded as one piece with the upper slide member 200, as shown in FIG. 8. The plastic shell 252 receives and supports a padded portion 254 of the armrest 250, which is covered by an outer surface covering 256. The outer surface covering 256 is preferably a smooth, breathable material. The armrest 250 is preferably curved about an axis extending parallel to the axis 202 along the length of the armrest. The armrest 250 is preferably constructed so that the forward end 258 (FIG. 7) of the armrest is raised upward at an angle of about 7° from the horizontal relative to the back end 260.

The various joints of the armrest assembly 10 provide for motion and positioning of the armrest in multiple degrees of movement.

First, the support tube 130 is positionable forward and backward by pivotal movement of the swing arm 58 about the axis 60. The support tube 130 can be locked in the selected position by the lock screw 64. This is usually an adjustment which need be made only once by a particular person sitting in a particular chair.

Second, the support tube 130 is positionable upward and downward by movement of the lock screw 122 and spring guide 110 in the upright 70 and in the bearing 80. The vertical position can then be set by tightening the lock screw 122. Again, this is usually an adjustment which need be made only once by a particular person sitting in a particular chair.

Third, the support tube 130 is pivotal within the upright 70, about the axis 138, to move the armrest 250 arcuately.

Fourth, the armrest 250 is pivotal about the axis 178, by rotation of the support post 170 within the socket member 144.

Fifth, the armrest 250 is slidable forward and backward in a direction parallel to the axis 202.

These multiple degrees of motion can be used to provide proper support and positioning of the arm and hand of most anyone seated in or on a chair or seat of any type. This can be, for example, a computer operator; an assembler or technician working at a work table or bench; a writer; an assembly line worker; etc. These multiple degrees of freedom mean that not only can the armrest itself be positioned (relative to the chair) as desired, but that once the occupant's arm is on the armrest, the arm can be moved to any position in the same plane (within reach) without lifting the arm from (or sliding the arm along) the armrest. Thus, the present invention is not limited to office chairs but is more extended in scope, as indicated by the appended claims.

Thus, it can be seen that the armrest assembly 10 is easily attachable to the chair 12 without structural change to the chair. This is because the base plate 30 is adapted to be secured intermediate the pedestal assembly 16 and the seat bottom cushion 14, with the fasteners 24 extending through the fastener openings 36 in the base plate between the pedestal assembly upper portion and the seat bottom cushion when the armrest assembly 10 is attached to the chair 12. If, as is preferable, the base plate 30 has at least two sets of fastener openings 36 and 38, respectively, arranged in different patterns, the armrest assembly is easily attachable to a number of different chairs without structural change to any of the chairs.

The fact that the armrest 250 itself slides relative to the armrest support 130 provides for an additional degree of movement (see FIG. 10) for the arm not found in other armrest assemblies. Specifically, it allows a person's hand to move laterally (for example, along a keyboard having keys arranged in a straight line) without lifting the arm off from the armrest 250 or sliding along the armrest. If the arm would only pivot, for example about the axis 138 or the axis 178, the hand would travel in an arcuate path. The hand would not be able to follow a row of keys on the keyboard as it moves across the keyboard. However, with the sliding motion provided by the armrest assembly 10 of the present invention, the hand can move forward and backward as well as pivot. This compensates for the arcuate motion provided by a pivot joint, and allows the hand to travel as desired by the operator.

Figure 9:
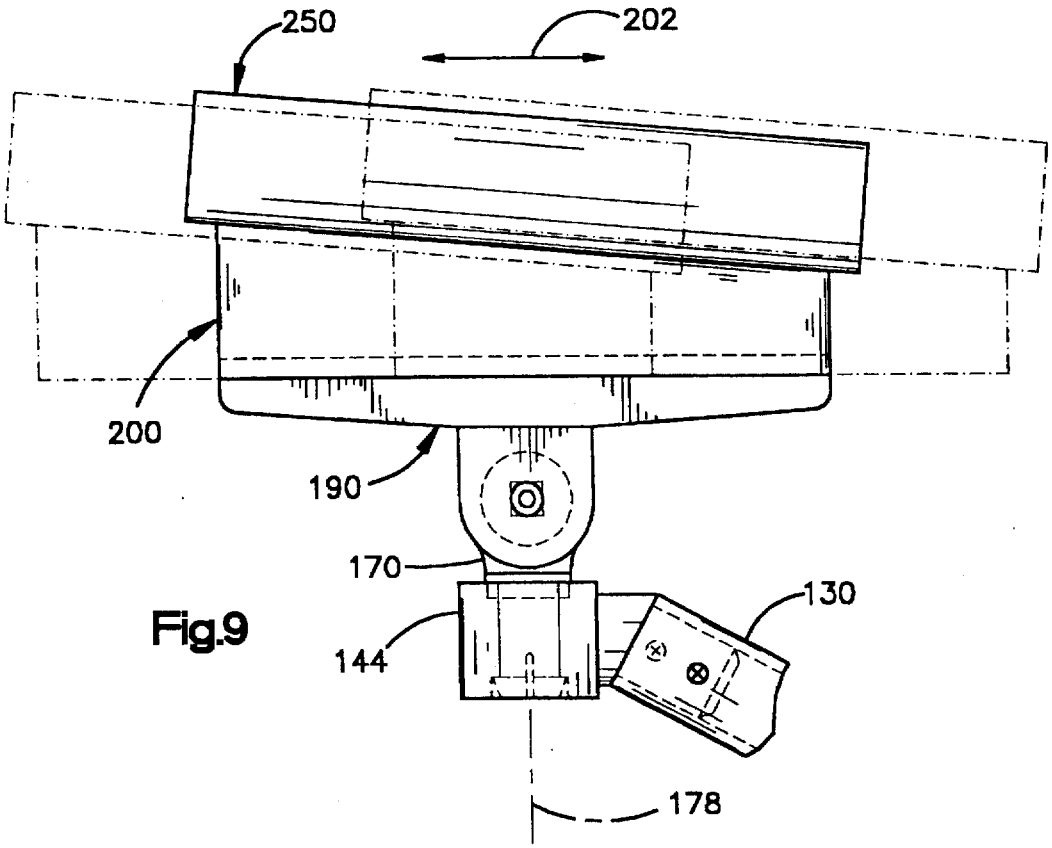
FIG. 9 is a schematic view illustrating the sliding movement of the armrest.
Figure 10:
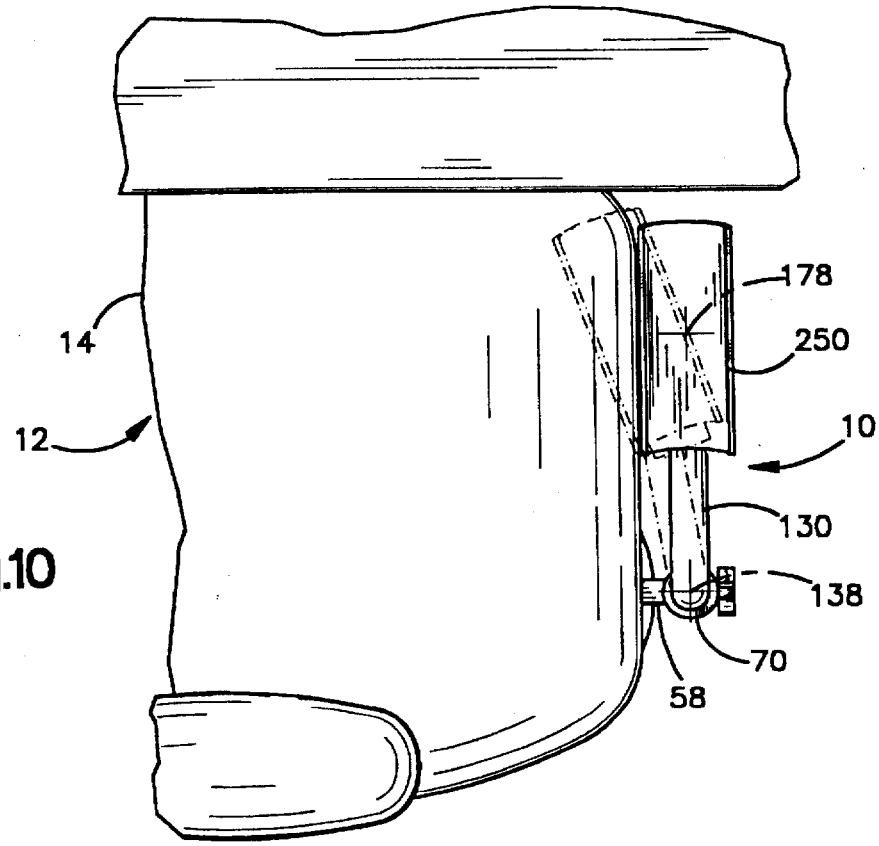
FIG. 10 is a schematic top plan view of the chair and armrest assembly of FIG. 1 illustrating the various degrees of movement of the armrest.

This is illustrated, for example, in FIGS. 9 and 10. FIG. 9 shows how the armrest 250 along with the upper slide member 200 is slidable in a direction parallel to the axis 202, relative to the lower slide member 190. FIG. 10 shows how the armrest 250 is simultaneously movable about three axes so that it can effectively be positioned in almost any location within the plane of its movement parallel to the ground. The support tube 130 can be pivoted about the vertical axis 138. The armrest 250 can be pivoted about the vertical axis 178. And the armrest is slidable in a direction parallel to the axis 202. Thus, instead of the armrest 250 traveling only in an arcuate path if only pivot joints are provided, the armrest 250 instead can move laterally, parallel to, for example, the front edge of a desk 280.

Figure 14:
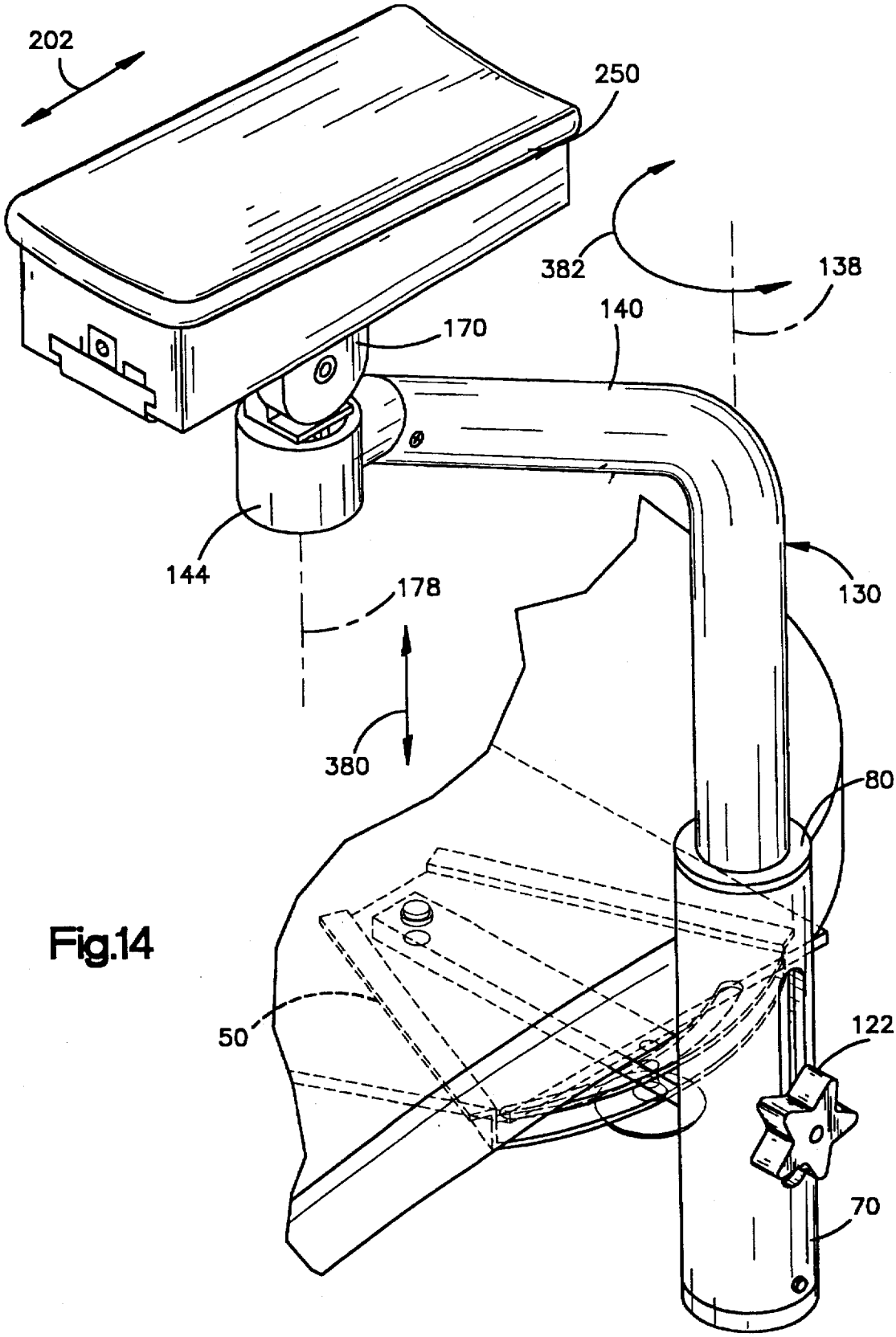
FIG. 14 is a perspective view illustrating the various axes of movement of the armrest assembly.

FIG. 14 again illustrates how the armrest assembly of the present invention provides for movement of an armrest in any combination of three axes. The armrest 250 is movable in a linear direction parallel to the axis 202 (which axis is generally parallel to the floor). This linear movement is a result of the sliding joint between the upper and lower slide members which support the armrest 250. The armrest 250 is movable in a linear direction perpendicular to the floor, as indicated by the arrow 380 extending parallel to the axis 138. This linear movement is a result of the permissible vertical movement between the armrest support member 130 and the upright 70. The armrest 250 is movable arcuately in a plane generally parallel to the floor, as indicated by the arrow 382. This arcuate movement is a result of the pivot joint between the armrest support post 170 and the socket member 144, and the pivot joint between the armrest support member 130 and the upright 70.

In accordance with another feature of the invention, the armrest assembly 10 is responsive to downward force on the armrest 250 from the person's arm to limit free movement of the armrest relative to the base plate 30. Because the upper and lower slide members 200 and 190 are made of plastic, pressure (i.e., weight of the arm or gravity) increases the friction between the upper slide member 200 and the lower slide member 190 through the steel ball bearings 232. Pressure (i.e., weight of the arm or gravity) also increases the friction between the support post 170 and the socket member 144, and between the lower end 128 of the support tube and the spring guide 110. This increased friction can effectively "lock" the armrest 250 into a given position, either partially or completely providing a more stable working platform. The selection of materials and the configuration of the relatively moving surfaces can thus provide free movement when desired and restriction of movement when desired.

The frictional locking may be obtained by choice of materials. In a preferred embodiment, the following parts of the armrest assembly are made of the following materials. The support post 170, the socket member 144, the upper slide member and the lower slide member, are all made of Delrin® brand plastic. Also, the bearing 80 and the spring support 110 are made of Delrin® brand plastic. The ball bearings 232 are made of steel. The steel of the ball bearings slides more easily against the Delrin, as compared to Delrin against Delrin. This is desirable since the sliding joint under the armrest is the most moved joint in the armrest assembly, and therefore less friction is desired there. The support tube 130 is also made of steel, mainly for strength.

The frictional locking means that one does not have to adjust a knob to lock the various members in a working position. The armrest is movable easily into position then is immediately and without substantial effort placed in a "locked" condition for working. When the term "move freely" is used herein, it means that the armrest is not physically blocked from movement as by one piece abuttingly engaging another and completely blocking movement. When the term "working condition" is used herein, it means that the armrest is in a physical location suitable for supporting a person's arm in a work position and is ready for use, not needing locking knob adjustment, etc.

Figure 8A:
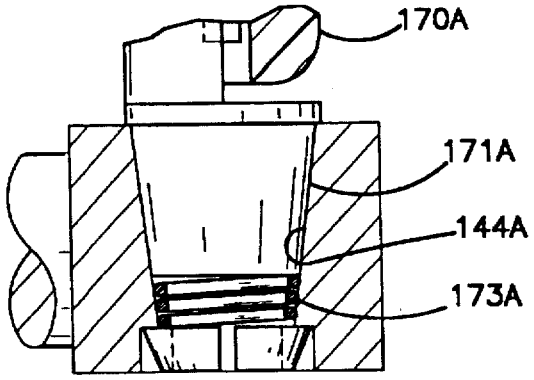
FIG. 8A is a view of an alternate support post construction.

Alternative joint constructions can be used to provide this "self-locking" feature. For example, as illustrated in FIG. 8A, a support post 170A can have a tapered outer surface 171A received in a tapered socket 144A. A spring 173A may be provided to bias the support post 170A upwardly in the socket 144A. When the support post 170A is up, without weight on it, it is freely rotatable in the socket 144A. When weight is applied to the support post 170A, the tapered surface 171A interengages with the tapered socket 144A to increase the friction between the two parts. Appropriate selection of the materials and the tapers can provide the desired amount of frictional resistance to rotation of the support post 170A relative to the socket 144A.

Figure 11:
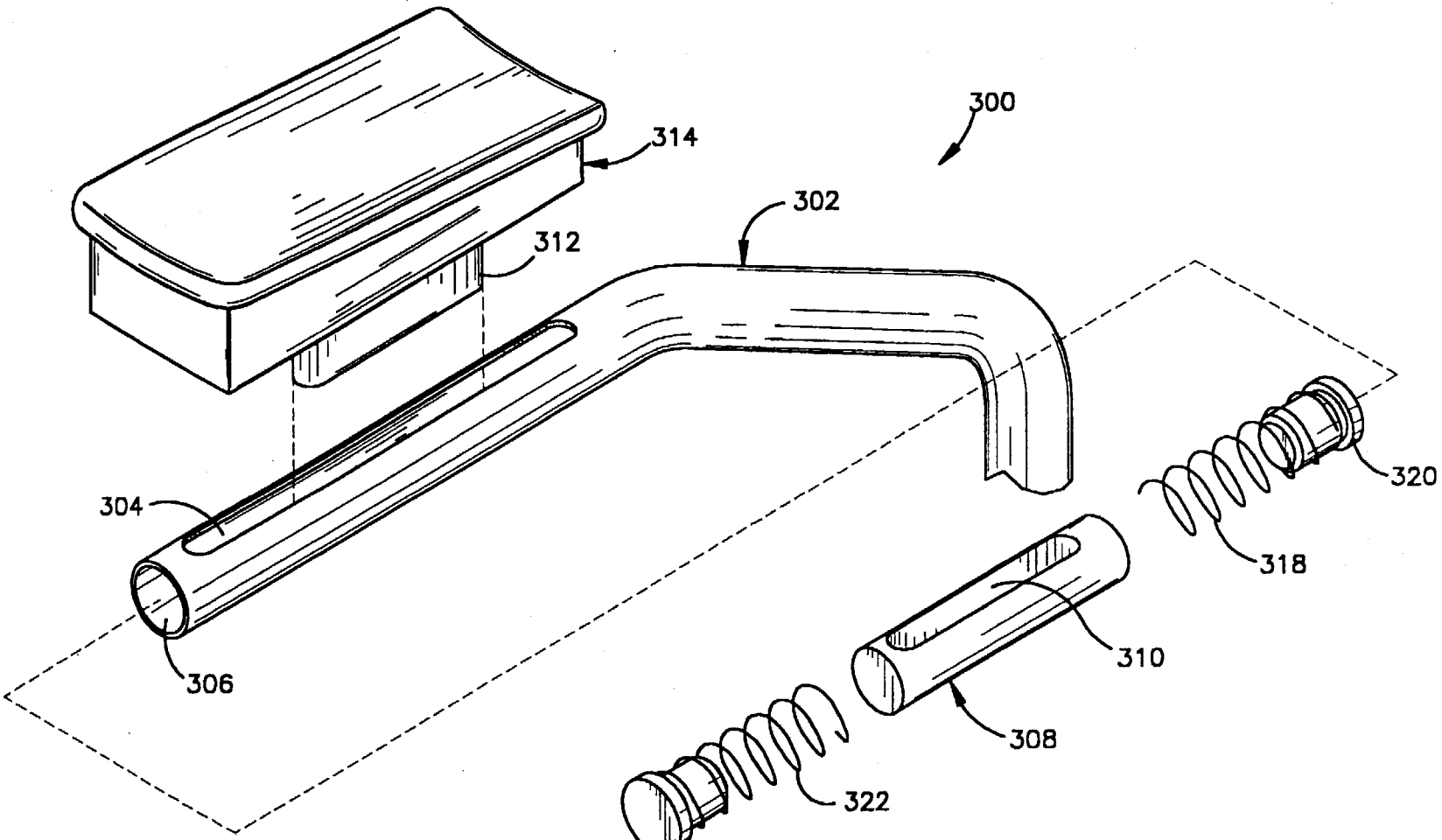
FIG. 11 is a schematic exploded view of a second embodiment of the armrest assembly of the present invention.

An alternative embodiment of an armrest slide is shown in an armrest assembly 300 illustrated in FIG. 11. A hollow support tube 302 has a longitudinally extending slot 304 and an open end 306. An inner slider 308 is received in the support tube 302. The inner slider 308 has a longitudinal slot 310 aligned with the slot 304 in the support tube 302. A projecting portion 312 of an armrest 314 extends through the slot 304 in the support tube 302 and is secured in the slot 310 in the inner slider 308.

The inner slider 308 is spring biased for self-centering movement in the support tube 302 by a spring assembly 316. The spring assembly 316 includes a spring 318 and a plug 320 disposed at the inner end of the inner slider 308 and a spring 322 and an end cap 324 on the other end of the inner slider. The end cap 324 closes the open end 306 of the support tube 302. The armrest 314 is thus slidable relative to the support tube 302.

Figure 12:
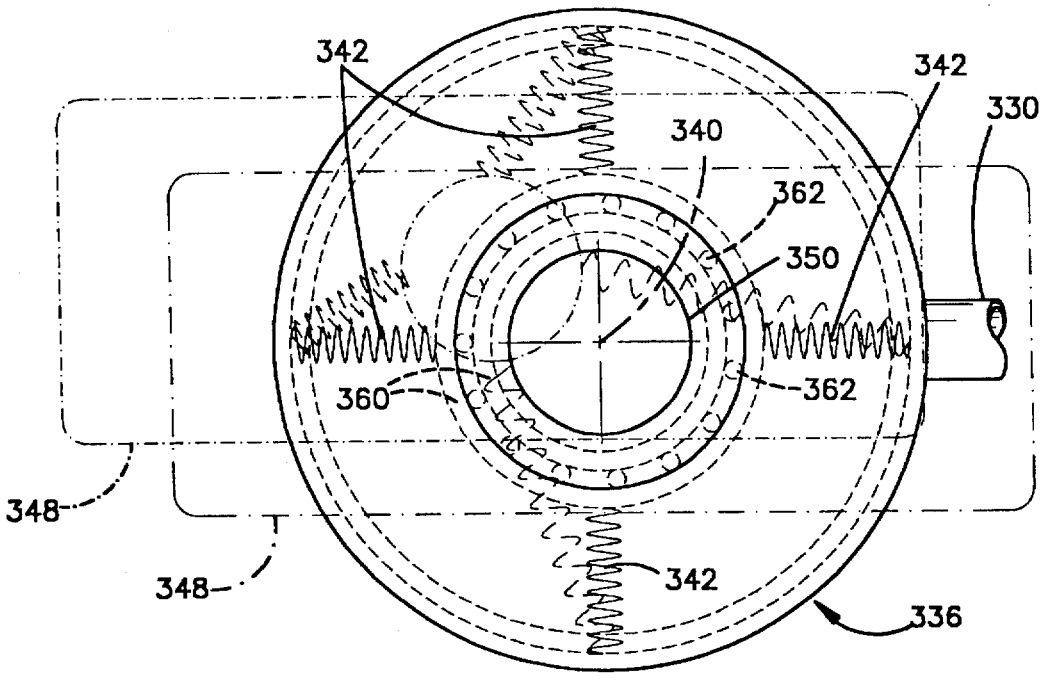
FIG. 12 is a top plan view of portions of a third embodiment of the armrest assembly of the present invention.
Figure 13:
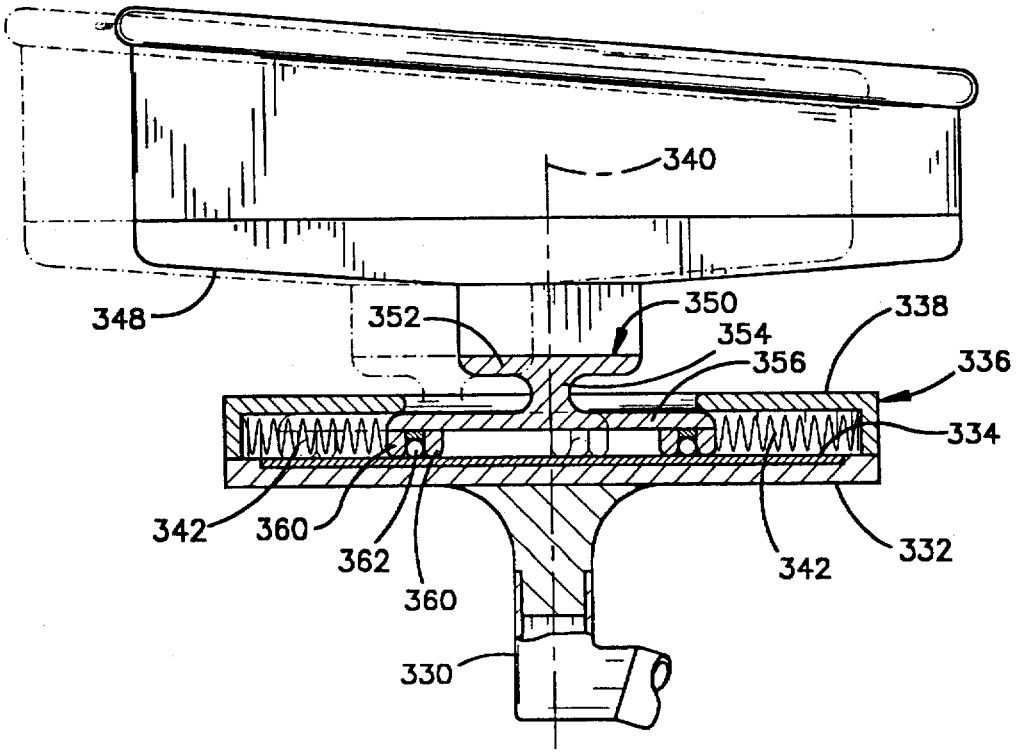
FIG. 13 is a schematic sectional view of the armrest assembly of FIG. 12.

Another alternative embodiment of an armrest slide is shown in FIGS. 12 and 13. A support tube 330 has a circular plastic base member 332 attached at its upper end.

The base member 332 supports a circular steel base plate 334. A circular plastic cover 336 extends upwardly from the plastic base member 332 and has a portion 338 extending radially inwardly toward a vertical axis 340 to define a slide chamber 342.

A circular armrest support slider 350 is received in the slide chamber 342. The support slider 350 has an upper portion 352 to which an armrest 348 is attached. The upper portion 352 is connected by a neck 356 to a circular planar portion 358. Two annular bearing races 360 extend downwardly from the planar portion 358 and secure between them a plurality of steel ball bearings 362. A steel washer 364 is disposed above the bearings 362. The ball bearings 362 support the slider 350 and thus the armrest 354 for sliding movement in any direction within the slide chamber 342. The armrest is self-centering by springs 361.

Thus, the armrest 354 is slidable relative to the support tube 330 in any direction for a limited extent. As indicated by the arrow 331, the armrest 348 is slidable fore and aft within the extent of travel allowed by the armrest slider 350 within the slide chamber 342. As indicated by the arrow 333, the armrest 348 is slidable laterally within the extent of travel allowed by the armrest slider 350 within the slide chamber 342. With these two combined, it can be seen that the roller bearing assembly provides freedom of movement of the armrest 348 in an improved manner, very useful for positioning the hand without lifting the arm off the armrest.

It should also be understood that the support parts of the armrest assemblies of the present invention could be used to support an element other than an armrest. For example, a writing platform could be attached rather than an armrest. The writing platform would thus be adjustable for position, then lockable in position by use of the lock screws and weight, as described above. Other structures could alternatively be supported.

Also, an armrest assembly in accordance with the present invention can be attached to something other than a chair. For example, an armrest assembly could be attached to a workbench, a desk, a table, or the like. In such case, the feature of the base plate being adapted to interfit with various different fastener patterns may not be applicable. However, the other features of the invention, including the sliding movement of the armrest and the frictional locking feature would be applicable.

From the above description of the invention, those skilled in the art will perceive improvements, changes and modifications in the invention. Such improvements, changes and modifications within the skill of the art are intended to be covered by the appended claims.

I claim:

1. An armrest assembly for use with a chair having a seat which is engaged by a person sitting on the seat, said armrest assembly comprising a tubular support member, said tubular support member including surface means for at least partially defining a slot, an armrest which extends through said slot in said tubular support member and is movable along said slot in said tubular support member under the influence of force transmitted from an arm of a person sitting on the seat of the chair, said tubular support member having a cylindrical inner side surface, and a cylindrical slider disposed within said tubular support member, said cylindrical slider having a cylindrical outer side surface area disposed in engagement with the cylindrical inner side surface of said tubular support member, said armrest including a portion which extends through said slot and is connected with said cylindrical slider.

2. An armrest assembly as set forth in claim 1 wherein said tubular support member includes an upright lower portion, an upper portion which extends transversely to said lower portion and an arcuate bend portion which extends between said lower portion and said upper portion of said tubular support member, said surface means for at least partially defining a slot being at least partially formed by said upper portion of said tubular support member and being spaced from said lower portion of said tubular support member.

3. An armrest assembly as set forth in claim 1 wherein said tubular support member includes an upright lower portion and upper portion which extends transversely to said upright lower portion, said surface means for at least partially defining a slot being at least partially formed by said upper portion of said tubular support member and being spaced from said lower portion of said tubular support member, said tubular support member being rotatable about a central axis of said upright lower portion of said support member under the influence of force transmitted from the arm of the person sitting on the seat of the chair to the armrest.

4. An armrest assembly as set forth in claim 1 wherein said slot in said tubular member has a longitudinal central axis which extends parallel to a longitudinal central axis of said tubular member.

5. An armrest assembly as set forth in claim 1 further including means for supporting said tubular support member for rotation about an axis which extends transversely to a longitudinal central axis of said slot under the influence of force transmitted from the arm of the person sitting on the seat of the chair to said armrest.

6. An armrest assembly as set forth in claim 1 wherein said tubular support member has an upright lower portion, an upper portion, and a continuously curving arcuate bend portion which extends between said upright lower portion and said upper portion of said tubular support member, said armrest assembly including a support assembly which engages said lower portion of said tubular support member and supports said tubular support member for rotation about a central axis of said upright lower portion of said tubular support member, said surface means for at least partially defining a slot being disposed in said upper portion of said support member, said armrest being movable along the slot in said upper portion of said support member along a path which extends transversely to the central axis of said upright lower portion of said tubular support member.

7. An armrest assembly for use with a chair having a seat which is engaged by a person sitting on the seat, said armrest assembly comprising a tubular support member, said tubular support member including surface means for at least partially defining a slot, said tubular support member having an open end portion adjacent to one end of the slot, an armrest which extends through said slot in said tubular support member and is movable along said slot in said tubular support member under the influence of force transmitted from an arm of a person sitting on the seat of the chair, an end cap closing the open end portion of said tubular support member, and a spring disposed within said tubular support member in engagement with said end cap to urge said armrest away from the one end of the slot.

8. An armrest assembly as set forth in claim 7 wherein said tubular support member includes an upright lower portion, an upper portion which extends transversely to said lower portion and an arcuate bend portion which extends between said lower portion and said upper portion of said tubular support member, said surface means for at least partially defining a slot being at least partially formed by said upper portion of said tubular support member and being spaced from said lower portion of said tubular support member.

9. An armrest assembly as set forth in claim 7 wherein said armrest assembly includes a slider disposed within said tubular support member, said slider having an outer side surface area disposed in engagement with an inner side surface of said tubular support member, said armrest including a portion which extends through said slot and is connected with said slider, said slider being urged away from the one end of the slot by said spring.

10. An armrest assembly as set forth in claim 7 wherein said tubular support member includes an upright lower portion and upper portion which extends transversely to said upright lower portion, said surface means for at least partially defining a slot being at least partially formed by said upper portion of said tubular support member and being spaced from said lower portion of said tubular support member, said tubular support member being rotatable about a central axis of said upright lower portion of said support member under the influence of force transmitted from the arm of the person sitting on the seat of the chair to the armrest.

11. An armrest assembly as set forth in claim 7 wherein said slot in said tubular member has a longitudinal central axis which extends parallel to a longitudinal central axis of said tubular member.

12. An armrest assembly as set forth in claim 7 further including means for supporting said tubular support member for rotation about an axis which extends transversely to a longitudinal central axis of said slot under the influence of force transmitted from the arm of the person sitting on the seat of the chair to said armrest.

13. An armrest assembly as set forth in claim 7 wherein said tubular support member has an upright lower portion, an upper portion, and a continuously curving arcuate bend portion which extends between said upright lower portion and said upper portion of said tubular support member, said armrest assembly including a support assembly which engages said lower portion of said tubular support member and supports said tubular support member for rotation about a central axis of said upright lower portion of said tubular support member, said surface means for at least partially defining a slot being disposed in said upper portion of said support member, said armrest being movable along the slot in said upper portion of said support member along a path which extends transversely to the central axis of said upright lower portion of said tubular support member.

14. An armrest assembly for use with a chair having a seat which is engaged by a person sitting on the seat, said armrest assembly comprising a tubular support member, said tubular support member including surface means for at least partially defining a slot, and an armrest which extends through said slot in said tubular support member and is movable along said slot in said tubular support member under the influence of force transmitted from an arm of a person sitting on the seat of the chair, said armrest including a guide portion which is disposed in said tubular support member and which has an outer side surface which engages an inner side surface of said tubular support member, said outer side surface of said guide portion being slidable along said inner side surface of said tubular support member upon movement of said armrest along said slot in said tubular support member.

15. An armrest assembly as set forth in claim 14 wherein said tubular support member includes an upright lower portion, an upper portion which extends transversely to said lower portion and an arcuate bend portion which extends between said lower portion and said upper portion of said tubular support member, said surface means for at least partially defining a slot being at least partially formed by said upper portion of said tubular support member and being spaced from said lower portion of said tubular support member.

16. An armrest assembly as set forth in claim 14 wherein said tubular support member includes an upright lower portion and upper portion which extends transversely to said upright lower portion, said surface means for at least partially defining a slot being at least partially formed by said upper portion of said tubular support member, said tubular support member being rotatable about a central axis of said upright lower portion of said support member under the influence of force transmitted from the arm of the person sitting on the seat of the chair to said armrest.

17. An armrest assembly as set forth in claim 14 wherein said slot in said tubular member has a longitudinal central axis which extends parallel to a longitudinal central axis of said tubular member.

18. An armrest assembly as set forth in claim 14 further including means for supporting said tubular support member for rotation about an axis which extends transversely to a longitudinal central axis of said slot under the influence of force transmitted from the arm of the person sitting on the seat of the chair to said armrest.

19. An armrest assembly as set forth in claim 14 wherein said tubular support member has an upright lower portion, an upper portion, and a continuously curving arcuate bend portion which extends between said upright lower portion and said upper portion of said tubular support member, said armrest assembly including a support assembly which engages said lower portion of said tubular support member and supports said tubular support member for rotation about a central axis of said upright lower portion of said tubular support member, said surface means for at least partially defining a slot being disposed in said upper portion of said support member, said armrest being movable along the slot in said upper portion of said support member along a path which extends transversely to the central axis of said upright lower portion of said tubular support member.

20. An armrest assembly as set forth in claim 14 wherein said tubular support member has an open end portion disposed adjacent to one end of the slot, said armrest assembly further including an end cap closing the open end portion of said tubular support member and a spring disposed within said tubular support member in engagement with said end cap to urge said armrest away from the one end of the slot.

21. An armrest assembly as set forth in claim 14 further including a plurality of springs disposed in said tubular support member to urge said guide portion of said armrest toward a predetermined position relative to said slot.

22. An armrest assembly for use with a chair having a seat, said armrest assembly comprising upper side surface means for engaging a portion of an arm of a person sitting on the seat of the chair, and support means for supporting said upper side surface means for combined pivotal and linear movement relative to the seat of the chair under the influence of force transmitted from the arm of the person sitting on the seat of the chair to said upper side surface means, said support means including a one-piece support member having an upright lower portion and an upper portion which extends transversely to said lower portion and is connected with said upper side surface means, said one-piece support member being supported for rotation about a central axis of said upright lower portion of said one-piece support member under the influence of force transmitted from the arm of the person sitting on the seat of the chair to said upper side surface means, and means for supporting said upper side surface means for movement along a linear path under the influence of force transmitted from the arm of the person sitting on the seat of the chair to said upper side surface means simultaneously with rotation of said one-piece support member about the central axis of said upright lower portion of said support member, said means for supporting said upper side surface means for movement along the linear path under the influence of force transmitted from the arm of the person sitting on the seat of the chair to said upper side surface means includes a slot which extends along said upper portion of said one-piece support member, guide means connected with said upper side surface means and extending into said slot to guide movement of said upper side surface means along said upper portion of said one-piece support member during rotation of said one-piece support member about the central axis of said upright portion of said one-piece support member, said upper portion of said one-piece support member includes an outer side surface and an inner side surface which at least partially forms a cavity within said one-piece support member, said slot being formed in said upper portion of said one-piece support member and extending between said outer side surface and said inner side surface to provide an opening to said cavity, said guide means including a guide member disposed within said cavity and slidable along said inner side surface of said one-piece support member, and a spring disposed in said cavity in said one-piece support member to urge said guide member towards an initial position in said cavity in said one-piece support member, said guide member being movable away from the initial position against the influence of said spring under the influence of force transmitted to said guide member from the arm of a person sitting on the seat of the chair through said upper side surface means.

23. An armrest assembly for use with a chair having a seat, said armrest assembly comprising upper side surface means for engaging a portion of an arm of a person sitting on the seat of the chair, and support means for supporting said upper side surface means for combined pivotal and linear movement relative to the seat of the chair under the influence of force transmitted from the arm of the person sitting on the seat of the chair to said upper side surface means, said support means including a one-piece support member having an upright lower portion and an upper portion which extends transversely to said lower portion and is connected with said upper side surface means, said one-piece support member being supported for rotation about a central axis of said upright lower portion of said one-piece support member under the influence of force transmitted from the arm of the person sitting on the seat of the chair to said upper side surface means, and means for supporting said upper side surface means for movement along a linear path under the influence of force transmitted from the arm of the person sitting on the seat of the chair to said upper side surface means simultaneously with rotation of said one-piece support member about the central axis of said upright lower portion of said support member, said means for supporting said upper side surface means for movement along the linear path under the influence of force transmitted from the arm of the person sitting on the seat of the chair to said upper side surface means includes a slot which extends along said upper portion of said one-piece support member, guide means connected with said upper side surface means and extending into said slot to guide movement of said upper side surface means along said upper portion of said one-piece support member during rotation of said one-piece support member about the central axis of said upright portion of said one-piece support member, and spring means for applying force against said guide means to urge said upper side surface means toward an initial position relative to said upper portion of said one-piece support member.

24. An armrest assembly for use with a chair having a seat, said armrest assembly comprising upper side surface means for engaging a portion of an arm of a person sitting on the seat of the chair, and support means for supporting said upper side surface means for combined pivotal and linear movement relative to the seat of the chair under the influence of force transmitted from the arm of the person sitting on the seat of the chair to said upper side surface means, said support means including a one-piece support member having an upright lower portion and an upper portion which extends transversely to said lower portion and is connected with said upper side surface means, said one-piece support member being supported for rotation about a central axis of said upright lower portion of said one-piece support member under the influence of force transmitted from the arm of the person sitting on the seat of the chair to said upper side surface means, and means for supporting said upper side surface means for movement along a linear path under the influence of force transmitted from the arm of the person sitting on the seat of the chair to said upper side surface means simultaneously with rotation of said one-piece support member about the central axis of said upright lower portion of said support member, said means for supporting said upper side surface means for movement along the linear path under the influence of force transmitted from the arm of the person sitting on the seat of the chair to said upper side surface means includes a slot which extends along said upper portion of said one-piece support member and guide means connected with said upper side surface means and extending into said slot to guide movement of said upper side surface means along said upper portion of said one-piece support member during rotation of said one-piece support member about the central axis of said upright portion of said one-piece support member, said slot extends only part way through said upper portion of said one-piece support member, said upper portion of said one-piece support member having an imperforate surface area on a side portion opposite from said slot.

25. An armrest assembly for use with a chair having a seat, said armrest assembly comprising an armrest engageable with a portion of an arm of a person sitting on the seat of the chair, and a one-piece tubular support member having an upright lower portion connected with the seat of the chair and an upper portion which extends transversely to said lower portion, said one-piece tubular support member being rotatable about a central axis of said upright lower portion of said one-piece tubular support member under the influence of force transmitted from the arm of a person sitting on the seat of the chair to said armrest, said upper portion of said one-piece tubular support member including surface means for defining a slot in said upper portion of said one-piece tubular support member, said surface means defines a slot in only one side of said upper portion of said one-piece tubular support member, said upper portion of said one-piece tubular support member having a continuous wall portion opposite from said slot, said armrest extending into said slot to guide movement of said armrest along said upper portion of said one-piece tubular support member under the influence of force transmitted from the arm of the person sitting on the seat of the chair to said armrest.

26. An armrest assembly for use with a chair having a seat, said armrest assembly comprising an armrest engageable with a portion of an arm of a person sitting on the seat of the chair, and a one-piece tubular support member having an upright lower portion connected with the seat of the chair and an upper portion which extends transversely to said lower portion, said one-piece tubular support member being rotatable about a central axis of said upright lower portion of said one-piece tubular support member under the influence of force transmitted from the arm of a person sitting on the seat of the chair to said armrest, said upper portion of said one-piece tubular support member including surface means for defining a slot in said upper portion of said one-piece tubular support member, said armrest extending into said slot to guide movement of said armrest along said upper portion of said one-piece tubular support member under the influence of force transmitted from the arm of the person sitting on the seat of the chair to said armrest, said armrest includes a guide portion disposed within said upper portion of said one-piece tubular support member, said guide portion having a surface which is disposed in engagement with and is slidable along an inner side surface of said upper portion of said one-piece tubular support member during movement of said armrest along said upper portion of said one-piece tubular support member.

27. An armrest assembly as set forth in claim 26 further including a spring disposed within said upper portion of said one-piece tubular support member to urge said guide portion of said armrest toward a predetermined position relative to said upper portion of said one-piece tubular support member.

28. An armrest assembly for use with a chair having a seat, said armrest assembly comprising an armrest engageable with a portion of an arm of a person sitting on the seat of the chair, a one-piece tubular support member having an upright lower portion connected with the seat of the chair and an upper portion which extends transversely to said lower portion, said one-piece tubular support member being rotatable about a central axis of said upright lower portion of said one-piece tubular support member under the influence of force transmitted from the arm of a person sitting on the seat of the chair to said armrest, said upper portion of said one-piece tubular support member including surface means for defining a slot in said upper portion of said one-piece tubular support member, said armrest extending into said slot to guide movement of said armrest along said upper portion of said one-piece tubular support member under the influence of force transmitted from the arm of the person sitting on the seat of the chair to said armrest, and a guide portion disposed within said upper portion of said one-piece tubular support member, said guide portion having a surface which is disposed in engagement with and is slidable along an inner side surface area of said upper portion of said one-piece tubular support member at a location disposed opposite from said slot.

29. An armrest assembly as set forth in claim 28 further including a spring disposed within said upper portion of said one-piece tubular support member to urge said guide portion of said armrest toward a predetermined position relative to said upper portion of said one-piece tubular support member.

30. An armrest assembly for use with a chair having a seat, said armrest assembly comprising an armrest engageable with a portion of an arm of a person sitting on the seat of the chair, a one-piece tubular support member having an upright lower portion connected with the seat of the chair and an upper portion which extends transversely to said lower portion, said one-piece tubular support member being rotatable about a central axis of said upright lower portion of said one-piece tubular support member under the influence of force transmitted from the arm of a person sitting on the seat of the chair to said armrest, said upper portion of said one-piece tubular support member including surface means for defining a slot in said upper portion of said one-piece tubular support member, said armrest extending into said slot to guide movement of said armrest along said upper portion of said one-piece tubular support member under the influence of force transmitted from the arm of the person sitting on the seat of the chair to said armrest, a first spring disposed in said upper portion of said one-piece tubular support member for applying force against said armrest urging said armrest in a first direction relative to said upper portion of said one-piece tubular support member upon movement of said armrest in a second direction opposite to the first direction under the influence of force transmitted from the arm of a person sitting on the seat of the chair to said armrest, and a second spring disposed in said upper portion of said one-piece tubular support member for applying force against said armrest urging said armrest in the second direction relative to said upper portion of said one-piece tubular support member upon movement of said armrest in the first direction under the influence of force transmitted from the arm of a person sitting on the seat of the chair to said armrest.

31. An armrest assembly as set forth in claim 30 wherein said armrest includes a guide portion disposed within said upper portion of said one-piece tubular support member and disposed between said first and second springs.

32. An armrest assembly for use with a chair having a seat, said armrest assembly comprising an armrest engageable with a portion of an arm of a person sitting on the seat of the chair, and a one-piece tubular support member having an upright lower portion connected with the seat of the chair and an upper portion which extends transversely to said lower portion, said one-piece tubular support member being rotatable about a central axis of said upright lower portion of said one-piece tubular support member under the influence of force transmitted from the arm of a person sitting on the seat of the chair to said armrest, said upper portion of said one-piece tubular support member including surface means for defining a slot in said upper portion of said one-piece tubular support member, said armrest extending into said slot to guide movement of said armrest along said upper portion of said one-piece tubular support member under the influence of force transmitted from the arm of the person sitting on the seat of the chair to said armrest, said upper portion of said one-piece tubular support member has an inner surface disposed within said upper portion of said one-piece tubular support member, said armrest including a guide portion disposed within said upper portion of said one-piece tubular support member and having an outer side surface with a configuration which corresponds to the configuration of the inner surface of said upper portion of said one-piece tubular support member, said armrest including a portion which extends through said slot and is connected with said guide portion, said outer side surface of said guide portion being slidable along the inner surface of said upper portion of said one-piece tubular support member under the influence of force transmitted from the arm of a person sitting on the seat of the chair to said armrest.

* * * * *